United States Patent [19]

Perry et al.

[11] Patent Number: 4,538,763

[45] Date of Patent: Sep. 3, 1985

[54] NOZZLE CONVENIENTLY ASSEMBLED AND DISASSEMBLED

[75] Inventors: Dennis A. Perry; David H. Wilmot, both of Nottingham, England

[73] Assignee: Hayden Nilos Conflow Limited, Sheffield, England

[21] Appl. No.: 475,233

[22] Filed: Mar. 14, 1983

[30] Foreign Application Priority Data

Mar. 26, 1982 [GB] United Kingdom ..... 8208996

[51] Int. Cl.[3] ..... B05B 1/00

[52] U.S. Cl. ..... 239/600; 175/422

[58] Field of Search ..... 239/600, 596, 589, 492; 175/422

[56] References Cited

U.S. PATENT DOCUMENTS

| | | | |
|---|---|---|---|
| 2,692,166 | 10/1954 | Fournier et al. | 239/600 X |
| 3,045,926 | 7/1962 | Steinen | 239/505 X |
| 3,088,679 | 5/1963 | Ford | 239/600 X |
| 4,169,560 | 10/1979 | Vohringer | 239/600 X |

*Primary Examiner*—Andres Kashnikow

*Assistant Examiner*—Kevin Patrick Weldon

*Attorney, Agent, or Firm*—Trexler, Bushnell & Wolters, Ltd.

[57] ABSTRACT

A liquid spray head 1 comprises a body portion 2, 2A, 2C, releasably located within a socket 5 of a housing 6, 6A, 6B, having a supply port 19 for pressurized liquid, the body portion 2, 2A, 2C, having an inner end 3 and an outer, liquid discharge end 4, and also having a liquid receiving chamber 17 intermediate these ends 3 and 4 and connected to the supply port 19 to receive liquid therefrom, whereby liquid pressure is operable on portions 46 of the chamber 17 and body portion 2, 2A, 2C, to urge the spray head 1 into the socket 5 so as to counter the effect of liquid pressure on other portions 38 of the spray head 1 tending to urge the body portion 2, 2A, 2C, from the socket 5; a liquid delivery path 22 extending from the chamber 17 to the liquid discharge end of the body portion 2; at least one liquid sealing means 8, 8C, provided between the inner end 3, 3C, of the body portion 2, 2A, 2C, and the socket 5; and abutment means 16, 42, 16C, on the body portion 2, 2A, 2C, engageable by an extraction tool.

7 Claims, 10 Drawing Figures

Fig. 4
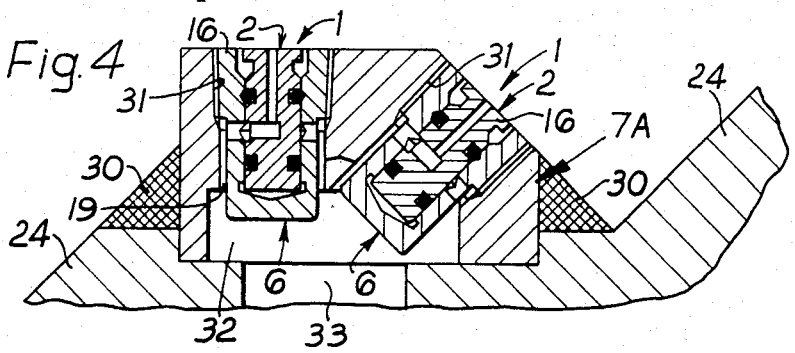
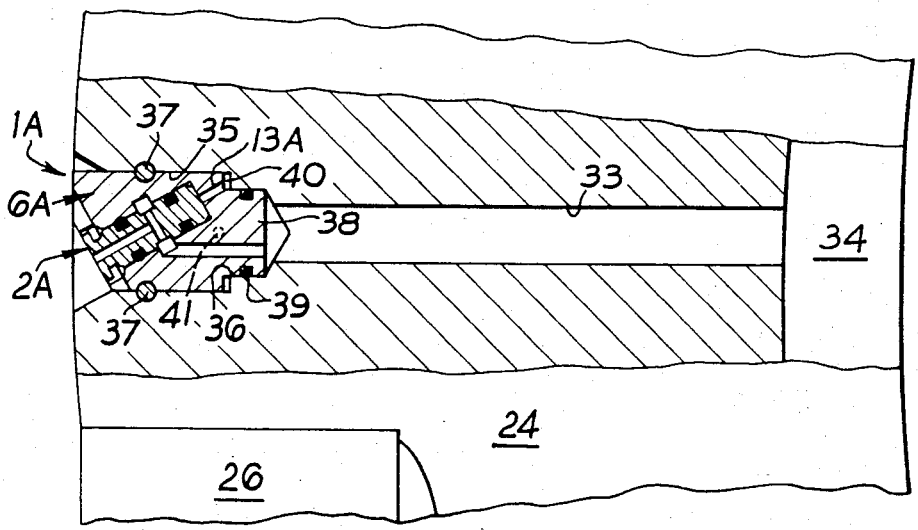
Fig. 5
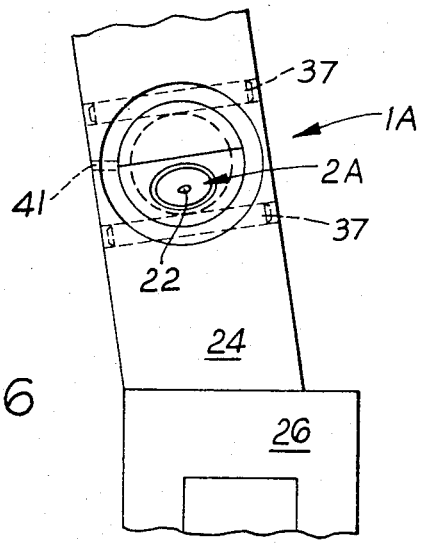
Fig. 6

NOZZLE CONVENIENTLY ASSEMBLED AND DISASSEMBLED

This invention relates to a liquid spray head particularly, though not exclusively for use on a coal face shearer cutting drum.

In the last mentioned application, spray heads are provided to suppress dust formation at the individual picks of the drum, and a problem with this type of spray head has been the difficulties encountered in the prevailing underground conditions of cleaning or changing a spray head, when blockage or damage occurs, which is quite frequent. Furthermore, care must be taken in the design of any simplified spray head retention means, as firstly the pressure of the water supplied to the head, and secondly centrifugal/inertia forces on the head, tend to dislodge the head.

According to the present invention, there is provided a liquid spray head comprising a body portion releasably located within a socket of a housing having a supply port for pressurized liquid, the body portion having an inner end and an outer, liquid discharge end and also having a liquid receiving chamber intermediate these ends and connected to the supply port to receive liquid therefrom, whereby liquid pressure is operable on portions of the chamber and body portion to urge the spray head into the socket so as to counter the effect of liquid pressure on other portions of the spray head tending to urge the body portion from its socket; a liquid delivery path extending from the chamber, to the liquid discharge end of the body portion; at least one liquid sealing means provided between the inner end of the body portion and the socket; and abutment means on the body portion engageable by an extraction tool.

If spray heads according to the invention were mounted on a coal face shearer cutting drum, then the liquid involved would be water.

In principle, by the presence of the water receiving chamber intermediate the ends of the body member, the force, resulting from the water pressure, tending to dislodge the body portion from its socket may be arranged to balance an equal pressure tending to retain the body portion, but preferably the arrangement is such that the retention force exceeds the dislodgement force and hence the body portion is positively urged into its socket whenever water pressure is available. Depending on the tolerances etc. between the body portion and its socket, any additional latching means between these two components may be unnecessary, but preferably mechanical means is provided to latch the body portion releasably within its socket. However, such latching means need only be designed to resist dislodgement forces resulting from centrifugal/inertia forces and so enabling relatively easy insertion and extraction of the body portion to be achieved. The extraction tool may be a screwdriver or similar tool for rapid removal of a body portion for cleansing or replacement.

The housing may be directly secured in selected position to provide the desired spraying effect or alternatively, the housing may itself be retained within a mounting socket, with the latter secured in the selected position with either arrangement, securing may be effected by welding, or by a pin, dowel or staple. In an embodiment where the housing is secured directly, it may be inserted into a radial hole of a vane of a shearer drum adjacent a pick box thereof i.e. parallel to the side faces of the vane, and after insertion is rotatable to the desired angular location, before securing e.g. by pins. In detail, in an embodiment where a mounting socket is provided the socket may have a radiussed bottom, to enable the socket to be welded readily in a selected angular position, after being fitted into a suitably chamfered hole e.g. in a vane of a shearer drum adjacent a pick box thereof, as the angular position of the picks with respect to the vanes is variable to suit the particular pick lacing required.

The spray head and/or body portion may produce a water spray of predetermined and fixed configuration, or alternatively the body portion may have a replaceable discharge head, to enable different spraying effects to be attained, e.g. a head producing a coherent spray may be replaced by a head producing a conical spray. The liquid delivery path may be constituted by a bore extending along the spray head or alternatively by an annular gap between the external periphery of the outer end of the body portion and the internal periphery of the socket. Furthermore, if the spray head has an axial bore, this may be intersected by at least one tangential bore if a swirling spray is required.

The sealing means may comprise a ring of resilient-/deformable material e.g. rubber or synthetic plastics, while both the inner and outer parts of the body portion may have individual sealing rings.

The abutment means may be constituted by a rib, flange or shoulder at the outer end of the body portion.

With a latching means present, this may comprise a ring of resilient or spring material located in a groove in the body portion of the spray head and adapted to engage an aligned groove in the socket, the ring expanding into the socket groove after insertion of the body member into the socket. If the ring is of metallic material, e.g. spring steel, a water sealing ring will clearly be required, but in a preferred embodiment a single ring of rubber or resilient synthetic plastic material is arranged to effect in one element the dual function of mechanical latching and liquid sealing. A latching/sealing ring may be provided in the inner and/or the outer part of the body portion. In a preferred arrangement of this embodiment, the outer part is provided with a sealing-/latching ring and the inner part with a sealing ring.

Should any sealing ring on the inner part fail or become ineffective, it is preferred to provide a drainage port which intersects the innermost end of the recess to drain off any leaked water, to avoid a water pressure build up tending to urge the spray head from its recess.

Instead of being employed singly as would normally be the case with a shearer drum, the spray heads may be employed in multiple numbers, e.g. a bank of two or four, retained in a common housing. With this arrangement, it may be possible, as an alternative, for the abutment means to be constituted by a base of each head, so that the latter may simply be pushed out of the housing for cleaning/replacement. If, however, the bases of the heads are not accessible, then as before, an abutment means may be constituted by a rib, flange or shoulder at the outer end of the spray head, beneath which shoulder etc. a screwdriver etc., blade is engageable, so that the head may be pried from its housing.

The invention will now be described in greater detail, by way of examples, with reference to the accompanying drawings, in which:

FIG. 4 is a sectional view, corresponding to FIG. 1, showing a plurality of spray heads in a common housing;

FIG. 5 is a view, partly in section, of a portion of a vane of a spiral vane shearer disc incorporating a second embodiment of liquid spray head in accordance with the invention;

FIG. 6 is an end view of FIG. 5;

In all the Figures, like components are accorded like reference numerals.

Figure 1:
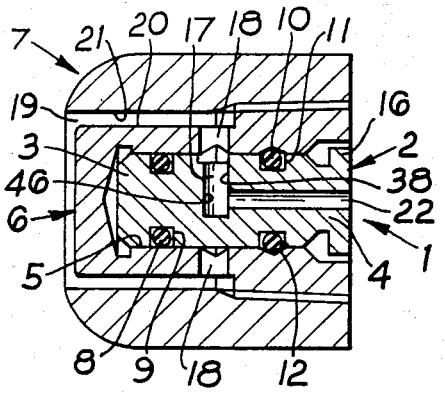
FIGS. 1 and 2 are sectional views, on different axes, of a first embodiment of liquid spray head in accordance with the invention.
Figure 2:
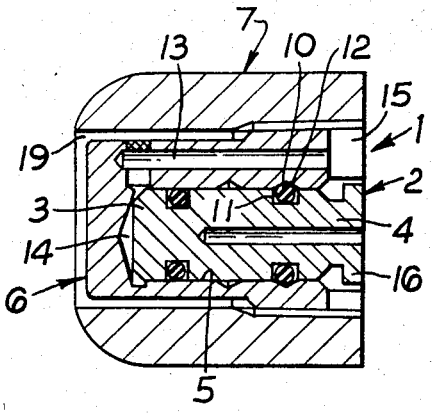
Figure 3:
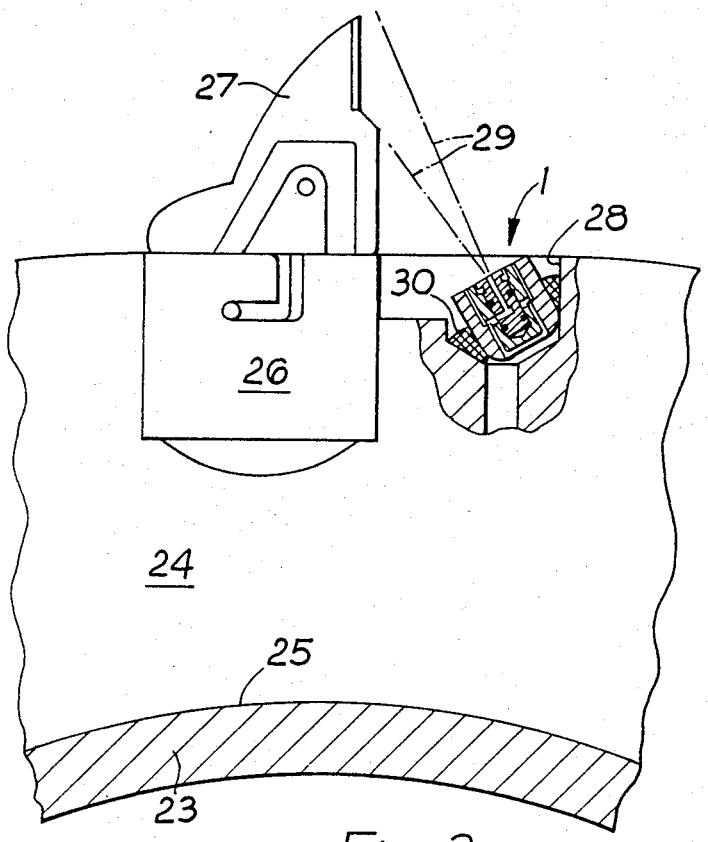
FIG. 3 is a view of a portion of a vane of a spiral vane shearer disc, incorporating the spray head of FIG. 1.

In the embodiment of FIGS. 1 to 3, a liquid spray head 1 comprises a body portion 2 having an inner end 3 and an outer, liquid discharge end 4. The body portion 2 is releasably located within a socket 5 in a housing 6, in turn located in a mounting socket 7.

The body portion 2 has a resilient sealing ring 8 located in a groove 9 in its inner end 3 and bearing against the socket 5, whilst a resilient sealing ring 10, serving for both mechanical latching and liquid sealing of the body portion 2 within the socket 5 is located in a groove 11 in the outer end 4 of the body member, the ring 10 locating, and sealing, in a groove 12 around the internal periphery of the socket 5. In the event that the sealing ring 8 should fail or become ineffective, a drainage port 13 connects area 14 of the socket to atmosphere at location 15.

The body portion 2 also terminates at its outer end 4 in an abutment means 16 engageable by an extractor tool, e.g. a screwdriver, to enable the body portion 2 to be removed from its socket 5 for cleaning and/or replacement.

Intermediate its ends 3 and 4 (and consequently its sealing rings 8 and 10, the body portion 2 is provided with a liquid receiving chamber 17 to receive pressurised liquid e.g. water, from diametral ports 18 communicating with an annular supply port 19 defined between the external periphery 20 of the housing 6 and the internal periphery 21 of the mounting socket 7. From the liquid receiving chamber 17 there extends a liquid delivery path in the form of a bore 22 from which the liquid is discharged in the form of a spray, discharge being effected at the terminal end of the bore 22.

As shown in FIG. 3, an outer barrel 23 of a spiral vane shearer drum has at least one spiral vane 24 welded to its outer periphery 25, the vane 24 being notched to receive a pick box 26 into which is inserted a replaceable pick 27. The vane 24 is also notched at 28 to receive a spray head 1 of the kind shown in FIGS. 1 and 2, the spray head being located in a selected angular position to produce a water spray 29 in the direction of the cutting face of the pick 27, with the spray head 1 being secured in that selected position by weld metal 30.

FIG. 4 illustrates that two spray heads 1, of the kind illustrated in FIGS. 1 to 3, may be secured in a common mounting member 7A having two holes 31 drilled therein at appropriate angles, with each hole 31 receiving one spray head 1. The spray heads 1 are angled in different directions e.g. so that one spray head 1 may spray in the direction of e.g. a leading pick, and the other spray head may spray in the direction of e.g. a trailing pick, while fluid to be sprayed is supplied to the annular ports 19 from a port 32.

In the embodiment of FIGS. 5 and 6, the spray head 1 does not have a mounting block (in contrast to FIGS. 1 to 3) the vane 24 being provided with a radially extending water supply port 33 communicating at one end with a water channel 34, and at the other end with first and second counterbored portions 35, 36 to receive a spray head 1A in accordance with a second embodiment of the invention. In this embodiment the body portion 2A is located at an angle in its housing 6A, the latter being retained in position by a pair of dowel pins 37, while a spigot 38 of the housing 6A has a liquid sealing ring 39 bearing against the portion 36. The housing 6A also has a drainage port 13A leading to an annular gap 40 having a vent hole 41.

Figure 7:
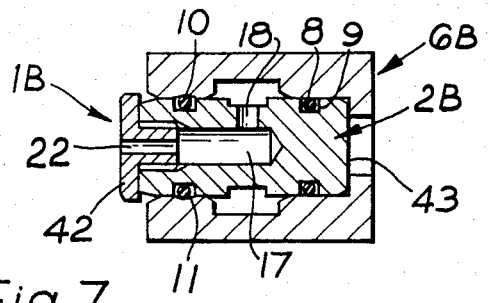
FIG. 7 is a sectional view through a third embodiment of liquid spray head in accordance with the invention located, with a plurality of similar spray heads, in a common housing.
Figure 8:
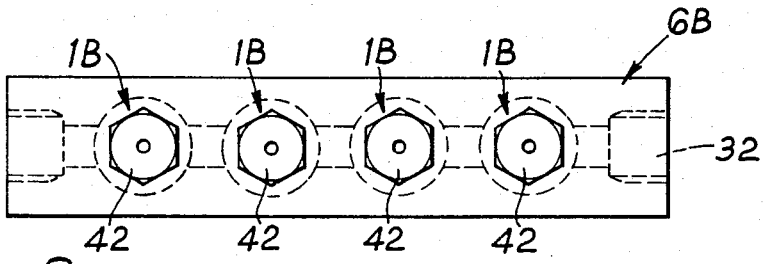
FIG. 8 is a side elevation of FIG. 7.
Figure 9:
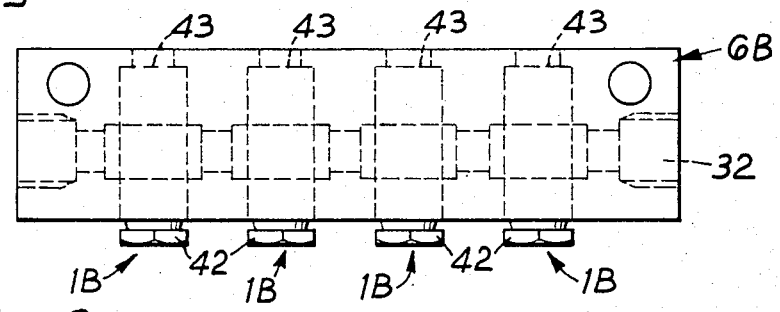
FIG. 9 is a plan view of FIG. 7.

In the embodiment of FIGS. 7 to 9, four spray heads 1B, in accordance with the third embodiment, are located in a common housing 6B, which may also serve as a mounting member. Each spray head 1B is provided with a replaceable discharge head 42, to enable different spraying effects to be attained. If a base portion 43 of the spray head is accessible, then the latter may be removed from its housing 6B by pressing a screwdriver etc. on the base portion 43. If however the base portion 43 is obscured, e.g. because the housing 6B is welded to a support plate, then the discharge head 42 may be so dimensioned as to constitute the abutment means to be engaged by a screwdriver etc. to extract the body portions 2B from their housing 6B.

Figure 10:
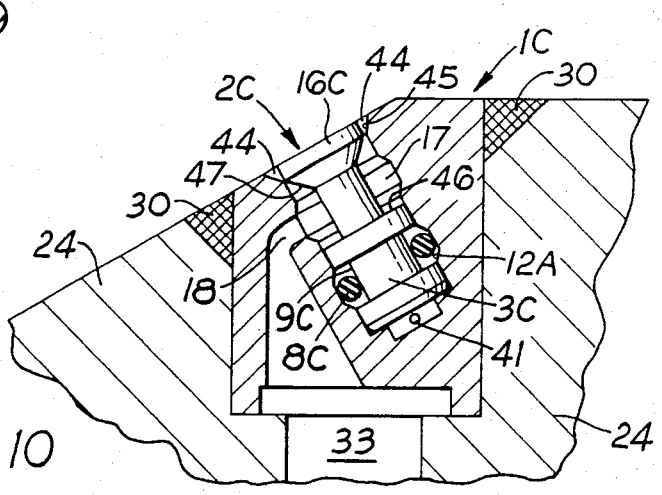
FIG. 10 is a sectional view through a fourth embodiment of liquid spray head in accordance with the invention.

Finally, in the embodiment of FIG. 10, there is illustrated a fourth embodiment of spray head 1C in accordance with the invention, this embodiment again having no mounting block and incorporating only one sealing ring 8C located in a groove 9C in the inner part 3C of the body portion 2C, the liquid delivery path being defined by an annular gap 44 between the external periphery of an abutment means 16C and the internal periphery 45 of an outer portion of the housing 6C.

In use, with water pressure available at the receiving chamber 17, the forces tending to urge the body portions 2, 2A, 2C into the housings 6, 6A, 6B—by acting on face 46 of the chamber 17 and on the sealing rings 8, 8C—are in balance, or can even be arranged to exceed, the forces tending to dislodge the body portions 2, 2A, 2C—by acting on face 47 of the chamber 17 and on any sealing ring 10—from the housings 6. 6A, 6B. Consequently, only a light duty latching arrangement is required which as indicated previously can be readily constituted by suitably selecting a material and dimensions for the sealing rings, 10 and 8C (FIG. 10), so that the single component can effect both mechanical latching and liquid sealing, while the abutment means 16, 16C can be so formed as to be engageable by a simple and readily available tool e.g. a screwdriver.

What we claim is:

1. A liquid spray head comprising a housing, a socket provided in said housing, a body portion releasably located within said housing socket, a supply port for pressurized liquid provided in said housing and disposed about the exterior surface of said body portion, said body portion having an inner end and an outer liquid discharge end, and an interior liquid receiving chamber provided intermediate said ends and connected to said supply port to receive liquid therefrom; a liquid delivery path extending from said chamber to said liquid discharge end of said body portion, said body portion further including liquid supply means opening to the exterior surface of said body portion and connecting said liquid receiving chamber and said liquid supply port provided by said housing, which liquid supply means is disposed to enter said liquid receiving chamber generally radially, in the absence of any axially oriented port means in said body portion leading to said liquid receiving chamber, and liquid sealing means providing a seal between the exterior of said body portion and the housing socket on the side of the liquid supply means corresponding to said inner end of the body portion to prevent liquid pressure from acting on any exterior axially facing surface areas of said body portion which would tend to force the body portion out of said socket, such that axially facing surface areas of the body portion upon which liquid pressure is operable are limited to those such that the resulting force does not tend to urge said body portion from the socket.

2. A spray head as claimed in claim 1, wherein said liquid supply means includes a liquid delivery path that is an annular path between an external periphery of said body portion and an internal periphery of said socket.

3. A spray head as claimed in claim 1, comprising a mounting socket, said housing being retained within said mounting socket which is securable in a selected position.

4. A liquid spray head in accordance with claim 1, wherein said axially facing surface areas upon which liquid pressure is operable are such that the resultant forces tend to urge said body portion into said socket.

5. A spray head as claimed in claim 3, wherein a radiussed bottom is provided on said mounting socket.

6. A spray head as claimed in claim 1, wherein mechanical means is provided to latch said body portion releasably within said socket.

7. A spray head as claimed in claim 6, comprising a groove located in said body portion of said spray head, an aligned groove in said socket, with said mechanical means comprising a ring of resilient material, said ring being located in said body portion groove and expanding into said recess groove after insertion of said body portion into said socket.

* * * * *